US005781989A

United States Patent [19]

Schmidt

[11] Patent Number: 5,781,989

[45] Date of Patent: Jul. 21, 1998

[54] FASTENER ATTACHING APPARATUS

[75] Inventor: Volker Schmidt, Lexington, Ky.

[73] Assignee: Eastlex Machine Corporation, Lexington, Ky.

[21] Appl. No.: 757,834

[22] Filed: Nov. 27, 1996

[51] Int. Cl.[6] ..... B23P 19/00

[52] U.S. Cl. ..... 29/787; 29/809; 29/818; 29/788; 227/18

[58] Field of Search ..... 29/771, 787, 788, 29/809, 818, 243.53, 243.54; 227/18, 19, 20, 30, 48, 50

[56] References Cited

U.S. PATENT DOCUMENTS

| | | | |
|---|---|---|---|
| 3,750,925 | 8/1973 | Schmidt et al. | 227/18 |
| 3,874,070 | 4/1975 | Falcioni | 29/243.53 X |
| 4,615,473 | 10/1986 | Taga | 227/18 X |
| 4,703,882 | 11/1987 | Herten | 227/18 X |
| 5,060,839 | 10/1991 | Seki | 227/18 |
| 5,263,627 | 11/1993 | Breuer et al. | 227/18 X |
| 5,319,848 | 6/1994 | Schmidt et al. | 29/787 |
| 5,339,984 | 8/1994 | Schmidt et al. | 227/18 X |
| 5,463,807 | 11/1995 | Hochhausi | 29/809 |
| 5,501,001 | 3/1996 | Kamps | 227/18 X |

*Primary Examiner*—S. Thomas Hughes
*Attorney, Agent, or Firm*—Frank C. Leach, Jr.

[57] ABSTRACT

Two mating fastener elements are attached to material and each other at a setting station through an electric motor. The motor rotates a cam having its profile cooperate with a cam follower on an upper pivotally mounted arm to move a ram, which supports one of the fastener elements, towards a support, which supports the other of the fastener elements. The support is moved by a lower pivotally mounted arm attached to the cam by a crank arm so that it has a harmonic motion. The ram is stopped and held in its stopped position before a controlled setting force is applied through the support to move the other fastener element into engagement with the one fastener element.

20 Claims, 6 Drawing Sheets

| FIG. 1A | FIG. 1B |
|---|---|

FASTENER ATTACHING APPARATUS

This invention relates to an attaching apparatus for attaching two mating fastener elements to each other and to a material and, more particularly, to an attaching apparatus having a single power source for causing the attachment of the two mating fastener elements to each other and to the material in which the application of power to each of the fastener elements is controlled.

U.S. Pat. No. 5,319,848 to Schmidt et al, which is incorporated by reference herein, attaches mating fastener elements to each other and to material. The aforesaid Schmidt et al patent employs a single power source, which is preferably an electric motor, for moving the two fastener elements into engagement with each other and the material to which they are to be attached. Thus, the single power source controls the motions of support means, which supports and moves one of the two mating fastener elements, and ram means, which moves the other of the two mating fastener elements. The aforesaid Schmidt et al patent has two separate hoppers supplying the two separate mating fastener elements to a setting station at which they can be attached to each other and to the material.

The aforesaid Schmidt et al patent preferably drives the support means and the ram means from the electric motor through two separate pivotally mounted arms. One of the pivotally mounted arms causes movement of the support means, and the other of the pivotally mounted arms causes movement of the ram means.

While the attaching apparatus of the aforesaid Schmidt et al patent functions satisfactory, it has been discovered that control of the motion of the ram means so that it is stopped when the two mating fastener elements are attached to each other reduces the amount of work required to attach the mating fastener elements to each other. This is particularly true when the mass of the lower fastener element, which is on the support means, is relatively large in comparison with the upper fastener element supported by the ram means.

For example, when the lower fastener element is a rivet having an elongated portion extending from its head of a relatively large length in comparison with the length of a cavity in a burr, the upper fastener element, into which the elongated portion is to be inserted, a greater setting force must be applied to the rivet. This is necessary to insure that the elongated portion of the rivet completely fills the cavity in the burr and also forms a compressed stem between the burr and the head of the rivet from the remainder of the elongated portion.

The attaching apparatus of the present invention is an improvement of the aforesaid Schmidt et al patent in that it controls the motion of the ram means so that its motion may be interrupted at a first desired time and held in this stopped position for a second desired time. This is preferably accomplished by a cam, which is rotated by the power source, cooperating with a cam follower on the upper pivotally mounted arm. The cam has its profile configured with a rising first portion to first move the upper pivotally mounted arm, then a constant second portion to stop and hold the upper pivotally mounted arm, and finally a falling third portion to return the upper pivotally mounted arm to its start position through a spring connected to the upper pivotally mounted arm.

This arrangement enables the ram means, which is moved by the first pivotally mounted arm, to be stopped before deformation of the fastener element, which is on the support means, begins. This allows a greater setting force to be applied to the lower fastener.

An object of this invention is to provide an attaching apparatus for attaching two mating fastener elements to each other and to material through using a single power source in which a controlled setting force is applied to each of the two mating fastener elements.

Another object of this invention is to provide an attaching apparatus for attaching two mating fastener elements to each other and to material through a single power source in which a greater setting force is applied to one of the two mating fastener elements than the other.

Other objects of this invention will be readily perceived from the following description, claims, and drawings.

This invention relates to an attaching apparatus for attaching first and second mating fastener elements to material at a setting station including support means and ram means at the setting station. First disposing means disposes a first fastener element at the setting station in a specific orientation for engagement by one of the support means and the ram means, and second disposing means disposes a second fastener element at the setting station in a specific orientation for engagement by the other of the support means and the ram means. Moving means creates movement of the support means and the ram means towards each other to attach the first fastener element and the second fastener element to each other at the setting station. The moving means includes a single power source for creating movement of the support means and the ram means towards each other, a first pivotally mounted arm for causing movement of the ram means when the single power source creates movement of the first pivotally mounted arm, a second pivotally mounted arm for causing movement of the ram support means when the single power source creates movement of the second pivotally mounted arm, and activation control means for controlling activation of each of the first pivotally mounted arm and the second pivotally mounted arm during a cycle of operation of the attaching apparatus. The activation control means causes movement of the ram means to be stopped prior to causing movement of the support means to be stopped during attachment of the first fastener element and the second fastener element to each other at the setting station.

This invention also relates to an attaching apparatus for attaching first and second mating fastener elements to material at a setting station including support means and ram means at the setting station. First disposing means disposes a first fastener element at the setting station in a specific orientation for engagement by one of the support means and the ram means, and second disposing means disposes a second fastener element at the setting station in a specific orientation for engagement by the other of the support means and the ram means. Moving means creates movement of the support means and the ram means towards each other to attach the first fastener element and the second fastener element to each other at the setting station. The moving means includes a single power source for creating movement of the support means and the ram means towards each other, first causing means for causing movement of the ram means when the single power source creates movement of the first causing means, second causing means for causing movement of the support means when the single power source creates movement of the second causing means, and activation control means for controlling activation of each of the first causing means and the second causing means during a cycle of operation of the attaching apparatus. The activation control means causes movement of the ram means to be stopped prior to causing movement of the support means to be stopped during attachment of the first fastener element and the second fastener element to each other at the setting station.

The attached drawings illustrate a preferred embodiment of the invention, in which.

Figures 1, 1A:
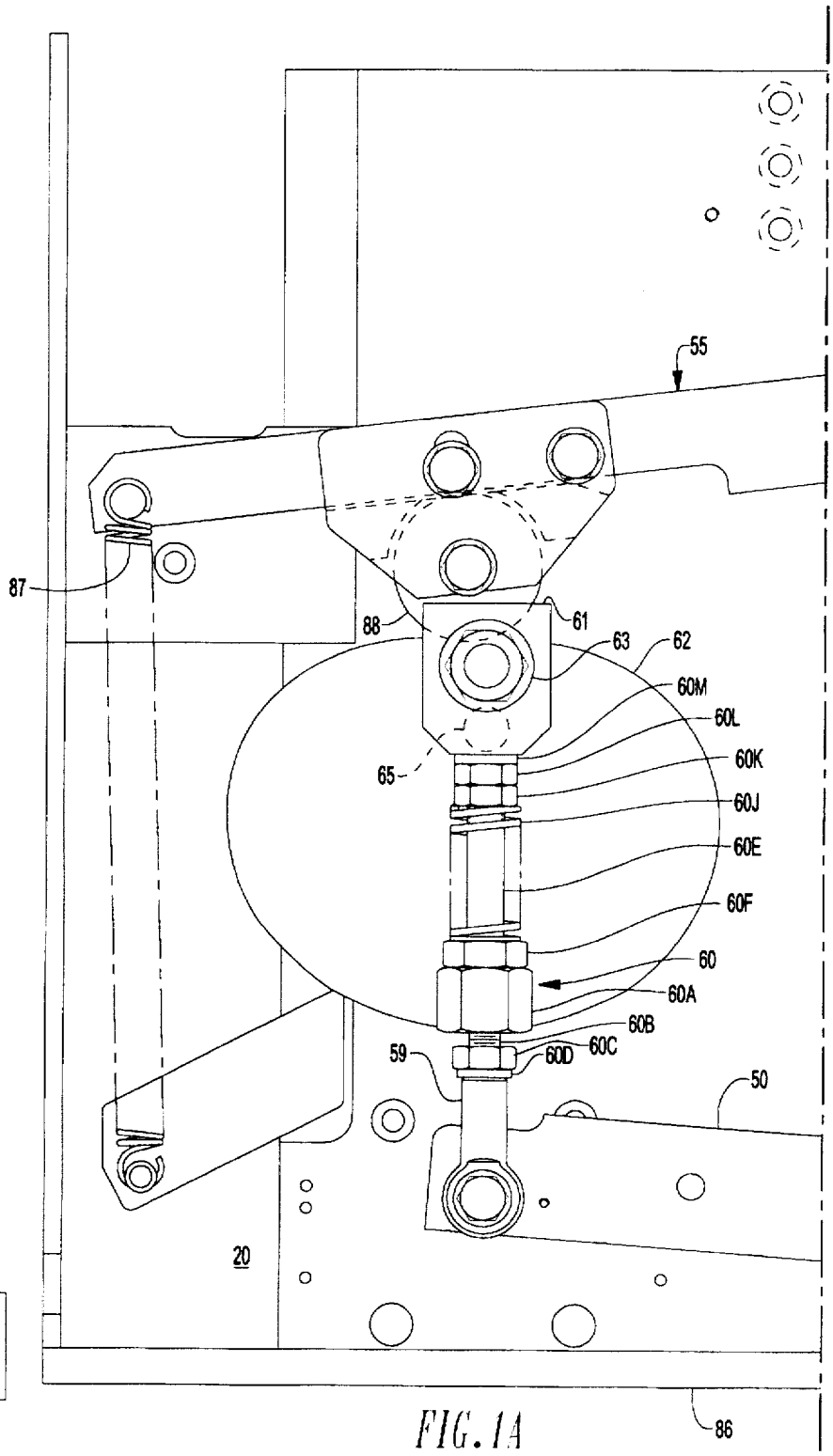
FIG. 1 is a block diagram showing the relationship of FIGS. 1A and 1B.
FIG. 1A is a side elevational view of a portion of an attaching apparatus of the present invention.
Figure 1B:
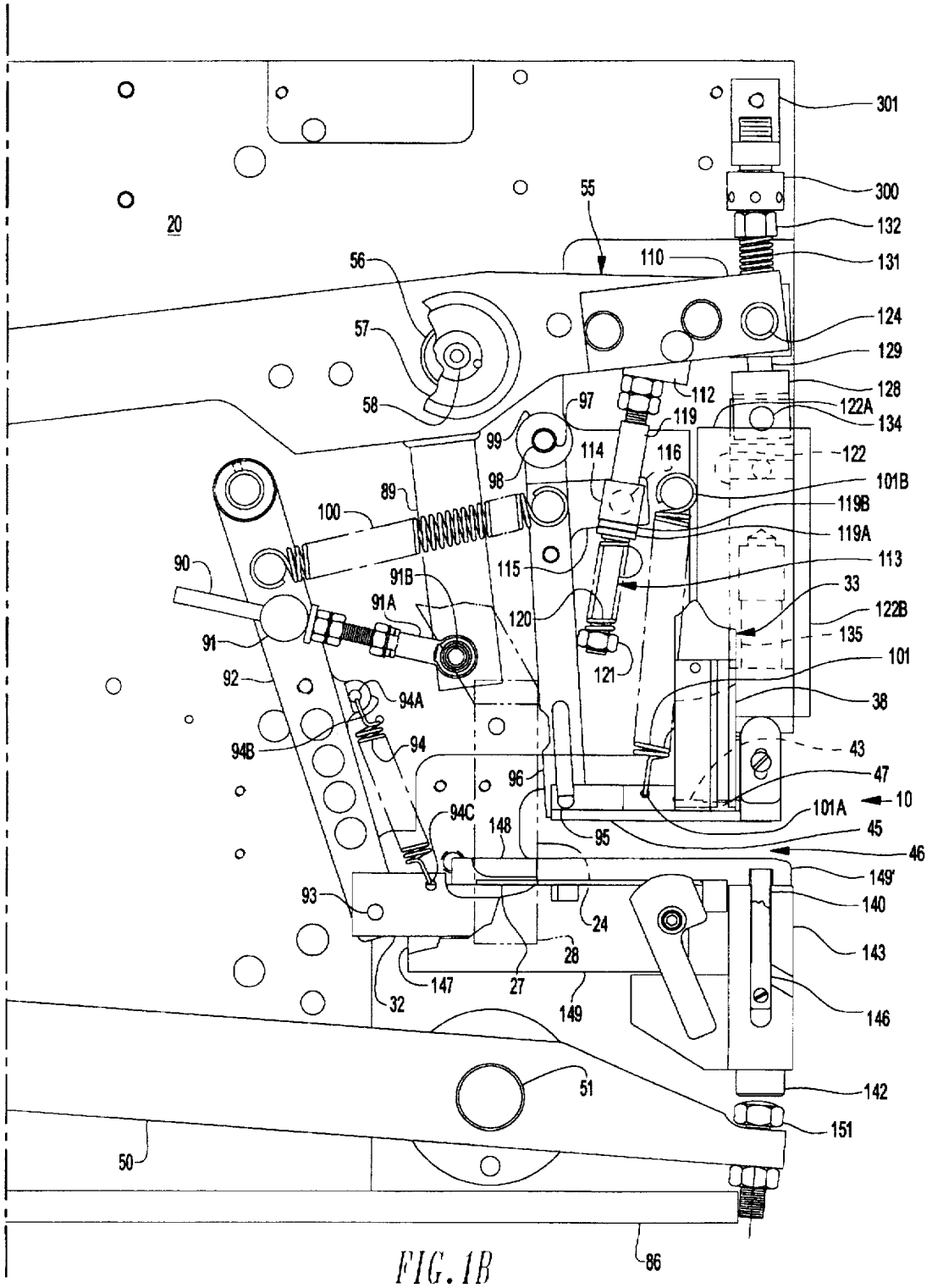
FIG. 1B is a side elevational view of the remainder of the attaching apparatus of FIG. 1A.

Referring to the drawings and particularly FIGS. 1A and 1B, there is shown an attaching apparatus 10 for attaching two mating fastener elements such as a burr 11 (see FIG. 3) and a rivet 12, for example, to each other with a material 14 therebetween. The burr 11 has a cavity or recess 15 (see FIG. 4) to receive an elongated portion 16 (see FIG. 3) of the rivet 12 extending from a head 17 of the rivet 12 when the burr 11 and the rivet 12 are attached to each other.

It should be understood that the mating fastener elements may be other than the burr 11 and the rivet 12. For example, the mating fastener elements could be a button and a rivet or a post and a stud. The attaching apparatus 10 (see FIGS. 1A and 1B) is capable of attaching any two mating fastener elements to each other with the material 14 (see FIG. 3) therebetween.

The attaching apparatus 10 (see FIG. 1B) includes a plate-like support 20 preferably having two hoppers (not shown) mounted at its upper end. In a manner similar to that shown and described in the aforesaid Schmidt et al patent, a feed chute 24, which includes a substantially vertical rail and a pair of covers secured to the substantially vertical rail, extends between a first of the hoppers and a guide channel 27 to transport each of the rivets 12 (see FIG. 3) from the first hopper to the guide channel 27 (see FIG. 1B).

Figure 2:
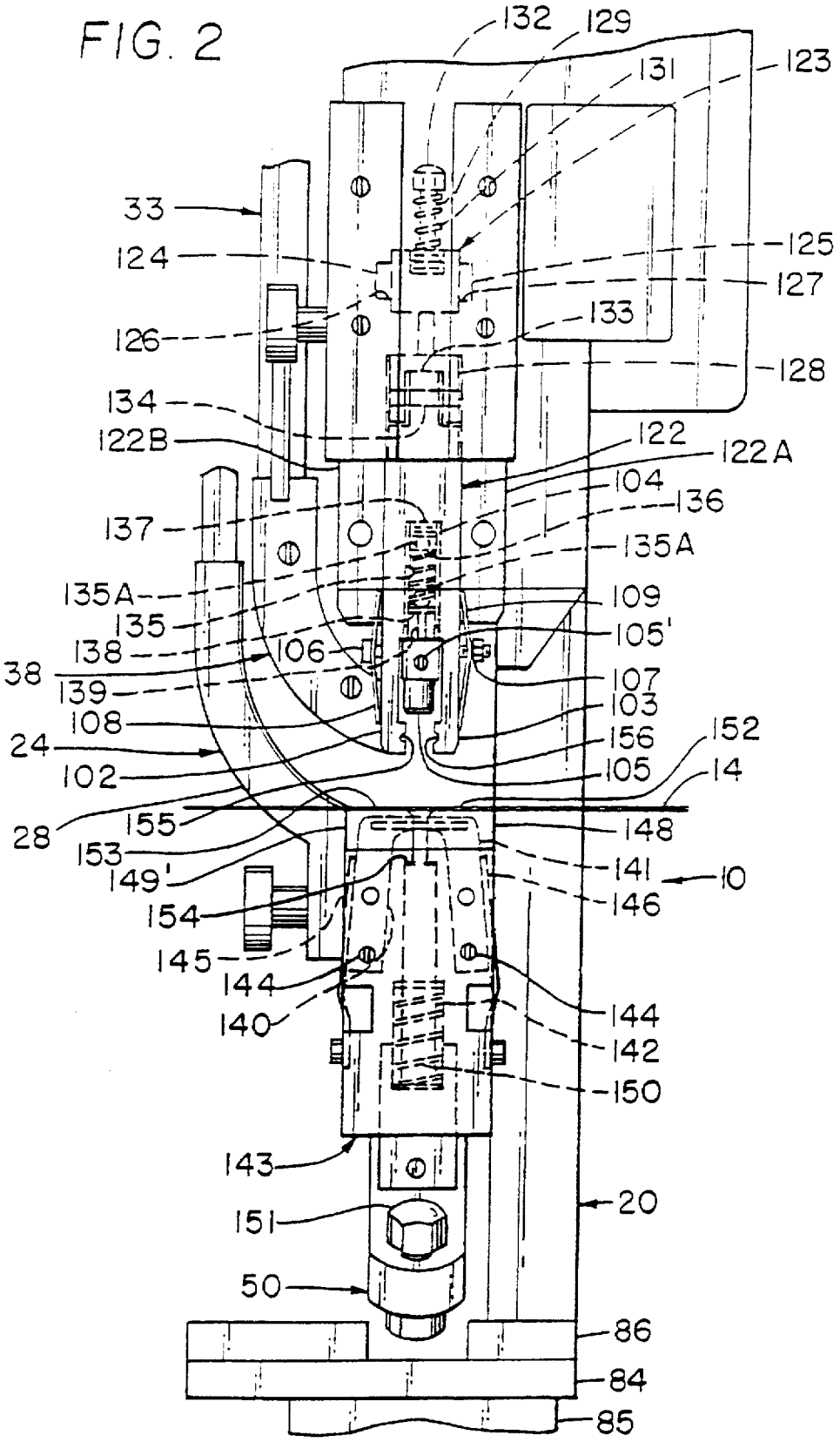
FIG. 2 is a fragmentary front end elevational view of the attaching apparatus of FIG. 1.

The feed chute 24 has a curved lower rail mount 28 (see FIG. 2) attached to the bottom end of the substantially vertical rail by screws with the covers having their bottom ends similarly connected to the curved lower rail mount 28. This arrangement enables transport of the rivets 12 (see FIG. 3) from the substantially vertical rail of the feed chute 24 (see FIG. 1B) to the guide channel 27. The upper end of the substantially vertical rail of the feed chute 24 communicates with the interior of the first hopper in the manner shown in the aforesaid Schmidt et al patent, for example, to transport each of the rivets 12 (see FIG. 3) from the first hopper to the space between the substantially vertical rail and the covers of the feed chute 24 (see FIG. 1B).

The guide channel 27 is particularly shown and described in U.S. Pat. No. 3,750,925 to Schmidt et al, which is incorporated by reference herein. The guide channel 27 aligns the elongated portion 16 (see FIG. 3) of the rivet 12 in the correct orientation as each of the rivets 12 is advanced through the guide channel 27 (see FIG. 1B) by a feed in finger or slide bar 32. The feed in finger 32 is reciprocated once during each cycle of operation of the attaching apparatus 10.

A second of the hoppers has the burrs 11 (see FIG. 3) therein. An upper feed chute 33 (see FIG. 1B) has its upper end supported by the second hopper for communication with the interior of the second hopper in the manner shown and described in the aforesaid Schmidt et al U.S. Pat., 5,319,848.

The upper feed chute 33 includes a rail and a cover attached to the rail by screws. The upper end of the upper feed chute 33 receives each of the burrs 11 (see FIG. 3) from the interior of the second hopper.

Figure 4:
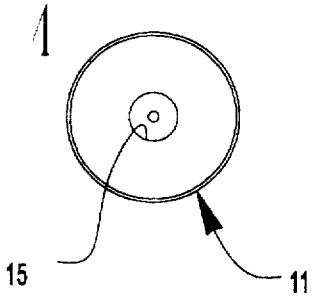
FIG. 4 is a plan view of one side of the burr of FIG. 3.
Figure 5:
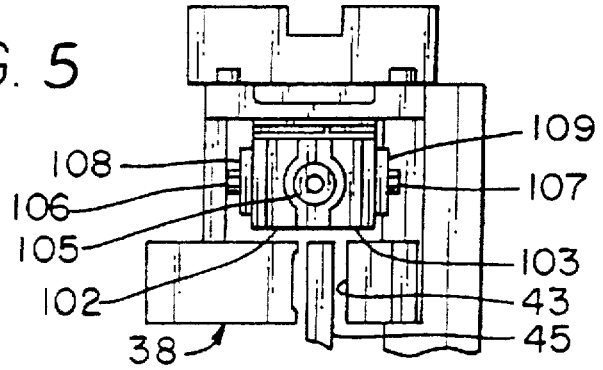
FIG. 5 is a fragmentary bottom plan view of a portion of the attaching apparatus of FIG. 1 and showing a guide channel within which each rivet enters a feed chute prior to the rivet being disposed at a setting station and a feed in finger disposed in the guide channel.

Each of the burrs 11 advances from the bottom end of the upper feed chute 33 (see FIG. 2) into a curved lower feed chute 38. The curved lower feed chute 38 includes a curved feed in rail having covers attached to its back and one of its sides to retain the burr 11 (see FIG. 3) within a groove in the rail. When the burr 11 exits from the curved lower feed chute 38 (see FIG. 2) to change from a vertical disposition when it entered the curved lower feed chute 38 to a horizontal position, the burr 11 (see FIG. 3) enters a horizontally disposed guide channel 43 (see FIG. 5) to orient the burr 11 (see FIG. 4) horizontally with the cavity or recess 15 in the burr 11 facing downwardly.

A feed in finger or slide bar 45 (see FIG. 5) reciprocates in the guide channel 43 between a position in which the lowermost of the burrs 11 (see FIG. 3) in the lower curved feed chute 38 (see FIG. 5) can enter the guide channel 43 to a position in which the burr 11 (see FIG. 3) is advanced in the guide channel 43 (see FIG. 1B) for disposition at a setting station 46. The advancement of the feed in finger 45 disposes a substantially horizontal portion 47, which is more particularly shown and described in the aforesaid Schmidt et al U.S. Pat. No. 5,319,848, of the feed in finger 45 to block the exit of the curved lower feed chute 38 (see FIG. 2) to prevent another of the burrs 11 (see FIG. 3) in the curved lower feed chute 38 (see FIG. 5) from entering the guide channel 43. The feed in finger 45 includes a vertical surface (not shown) to engage the burr 11 (see FIG. 3), which rests on a substantially horizontal surface (not shown) lower than the substantially horizontal portion 47 (see FIG. 1B) as shown and described in the aforesaid Schmidt et al U.S. Pat. No. 5,319,848, of the feed in finger 45 (see FIG. 1B), to advance the burr 11 (see FIG. 3) from the guide channel 43 (see FIG. 5). The feed in finger 45 is reciprocated once during each cycle of operation of the attaching apparatus 10 (see FIG. 1B).

During each cycle of operation of the attaching apparatus 10, there is pivotal motion of a lower power arm 50, which is pivotally mounted on a shoulder shaft 51 supported by the plate-like support 20. An E-ring (not shown) retains the lower power arm 50 on the shoulder shaft 51 through fitting in a groove in the end of the shoulder shaft 51.

During each cycle of operation, there also is pivotal movement of an upper power arm 55, which is pivotally mounted on a shoulder shaft 56 supported by the plate-like support 20. A cap 57, which is secured to the end of the shoulder shaft 56 by a screw 58 extending into a threaded hole in the end of the shoulder shaft 56, retains the upper power arm 55 on the shoulder shaft 56.

The lower power arm 50 is pivotally connected to a lower end bearing 59 (see FIG. 1A) of a push rod assembly 60. The push rod assembly 60 includes a retainer 60A having a lower threaded stud 60B threaded into a threaded hole (not shown) in the top of the lower end bearing 59. A nut 60C is retained in a desired position on the lower threaded stud 60B by a lock nut 60D to adjustably position the retainer 60A on the lower end bearing 59.

The upper end of the retainer 60A receives the lower end of a shaft 60E, which extends through a cap 60F. The cap 60F is threaded into a threaded into a hole (not shown) in the upper end of the retainer 60A. The shaft 60E has a key (not shown) in a keyway (not shown) for cooperation with a slot (not shown) in the cap 60F to prevent rotation of the shaft 60E.

A spring 60J surrounds the upper portion of the shaft 60E and has its bottom end acting against the top end of the cap 60F. Two jam nuts 60K and 60L are threaded on the threaded upper portion of the shaft 60E and the bottom jam nut 60K has the upper end of the spring 60J acting thereagainst. A lock washer 60M holds the top jam nut 60L in position.

The shaft 60E has its threaded upper portion received in a threaded hole (not shown) of a base 61. The push rod assembly 60 is connected to a cam 62 through having the base 61 attached to the cam 62 by a stud 63 extending through the base 61 and having its threaded end threaded into a threaded hole (not shown) in the cam 62.

The cam 62 is fixed to one end of a shaft 65, which makes one revolution during each cycle of operation of the attaching apparatus 10. The shaft 65 is rotatably supported on the plate-like support 20 through a bearing (not shown).

Figure 6:
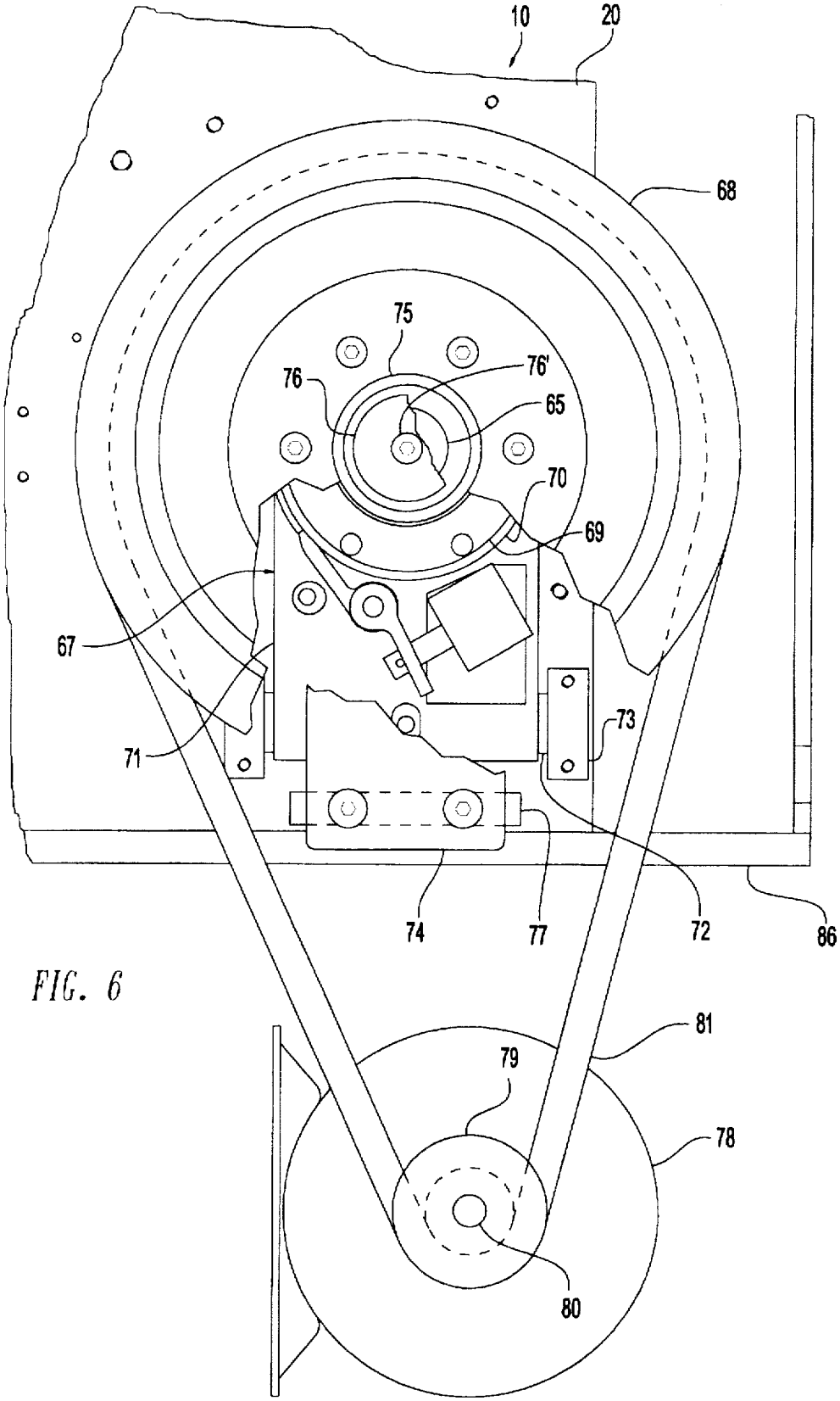
FIG. 6 is a fragmentary elevational view of a driving arrangement for rotating a cam during each cycle of operation of the apparatus.

The shaft 65 is rotated when a one revolution clutch such as a one revolution solenoid clutch 67 (see FIG. 6) is activated, for example, to connect the shaft 65 to a continuously rotating flywheel 68. The flywheel 68 is secured to a flange 69 on one end of a cylindrical portion 70 of the clutch 67 extending from a plate 71 of the clutch 67.

The clutch 67 has a cylindrical portion (not shown) disposed within a hole (not shown) in the plate-like support 20 with the cylindrical portion receiving the shaft bearing. The clutch 67 is prevented from rotating by the plate 71 being disposed between two rubber bumpers 72, which are retained within metal retainers 73 secured to the plate-like support 20.

The shaft 65 is rotatably supported in a holder 74 by a bearing 75. A cap 76 is secured to the end of the shaft 65 by a screw 76' extending through a hole in the cap 76 into a threaded hole in the end of the shaft 65. The cap 76 holds the cam 62 (see FIG. 1A) in the desired position. The holder 74 (see FIG. 6) is attached to a mount 77, which is mounted on the plate-like support 20.

The flywheel 68 is continuously rotated by a continuously rotating electric motor 78. The motor 78 has a pulley 79 mounted on its shaft 80. A belt 81 connects the pulley 79 and the flywheel 68.

The motor 78 is supported on a plate (not shown). The plate has an attached block (not shown) at its upper end supported on the bottom of a support plate (not shown) at the top of a vertical standard (not shown), which is supported by a base pedestal (not shown) through an adjustable sleeve (not shown). The support plate is attached to a base plate 86, which is secured to the plate-like support 20 and has the plate-like support 20 extending upwardly therefrom.

A spring 87 (see FIG. 1A) continuously urges the upper power arm 55 counterclockwise about the shoulder shaft 56 (see FIG. 1B) to maintain a cam follower 88 (see FIG. 1A), which is a bearing or roller, on the upper power arm 55 in continuous engagement with a profile or contour of the cam 62. Therefore, the movement of the upper power arm 55 is controlled by the profile or contour of the cam 62 during rotation of the cam 62.

Each of the feed in fingers 32 (see FIG. 1B) and 45 is reciprocated by motion of the upper power arm 55. The upper power arm 55 includes a downwardly extending portion 89 having its lower end pivotally connected to one end of a rod 90 through a rod end bearing 91A and a screw 91B. The rod 90 has its other end connected through a block 91 to a feed arm 92.

The feed arm 92 has its lower end pivotally connected by a screw 93 to one end of the feed in finger 32. A spring 94 extends from a hole 94A in an ear 94B of the feed arm 92 to a hole 94C in the feed in finger 32. The spring 94 continuously urges the feed in finger 32 upwardly counterclockwise about the pivot screw 93 during its reciprocation so that the feed in finger 32 is always positioned to engage the rivet 12 (see FIG. 3).

The feed in finger 45 (see FIG. 1B) is pivotally connected by a pivot pin 95 to the lower end of a lever 96. The lever 96 has its upper end pivotally mounted on the plate-like support 20 by a pivot pin 97 extending from the plate-like support 20 through a bushing 98 in a cylindrical bearing 99 of the lever 96. An E-ring (not shown) is disposed in a groove (not shown) in the pivot pin 97 to connect the lever 96, which is connected to the feed arm 92 by a spring 100, to the pivot pin 97.

A spring 101 has its lower end disposed in a hole 101A in the feed in finger 45 and its upper end connected to a stud 101B in the plate-like support 20. The spring 101 continuously urges the feed in finger 45 upwardly so that the substantially horizontal portion 47 is always held against the top of the guide channel 43 (see FIG. 5).

When the feed in finger 45 (see FIG. 1B) is advanced, the burr 11 (see FIG. 3) is advanced by the feed in finger 45 (see FIG. 1B) between two side plates 102 (see FIG. 2) and 103, which are mounted on a plunger 104 having a die 105 retained in its bottom end by a set screw 105'. The side plates 102 and 103 are mounted on the plunger 104 through a bolt 106 passing through the side plate 102, an elongated slot (not shown) in the plunger 104, and the side plate 103. The bolt 106 cooperates with a nut 107 to retain the side plates 102 and 103 on the plunger 104.

A spring 108 is disposed on the bolt 106 between the head of the bolt 106 and the side plate 102, and a spring 109 is disposed on the bolt 106 between the side plate 103 and the nut 107. The springs 108 and 109 enable the side plates 102 and 103 to separate slightly from each other to cease to hold the burr 11 (see FIG. 3) when the burr 11 and the rivet 12 are attached to each other and to the material 14.

The upper power arm 55 (see FIG. 1B) has a pair of brackets (one shown at 110) on opposite sides thereof and attached thereto adjacent one end thereof. A block 112 is retained between the two brackets 110 beneath the upper power arm 55.

A rod 113, which has its upper and lower ends threaded, has its upper end threaded into a threaded hole (not shown) in the lower end of the block 112. The rod 113 has its lower end extend through a passage (not shown) in a swivel 114.

An L-shaped bracket 115, which is attached to the lever 96, has a cylindrical pivot portion 116 of the swivel 114 pass through an opening (not shown) in the bracket 115 and retained therein by an E-ring (not shown) being disposed in a groove (not shown) in the cylindrical pivot portion 116. A sleeve 119 extends upwardly from the bottom of the swivel 114 through the passage in the swivel 114 to have the rod 113 pass therethrough. The sleeve 119 has its head 119A hold a washer 119B against the bottom of the swivel 114.

The rod 113 extends through an overtravel spring 120 beneath the swivel 114 to enable a nut 121 to be attached to the bottom threaded end of the rod 113. Thus, motion of the upper power arm 55 is transmitted to the lever 96 through the rod 113, the swivel 114, and the bracket 115 whereby the feed in finger 45 is reciprocated through pivoting of the lever 96 about the axis of the pivot pin 97.

As previously mentioned, the downwardly extending portion 89 of the upper power arm 55 is connected to the feed arm 92 for causing reciprocation of the feed in finger 32. Pivoting of the upper power arm 55 causes pivoting of the feed arm 92 to reciprocate the feed in finger 32. Accordingly, each of the feed in fingers 32 and 45 is reciprocated in each direction once during each cycle of operation of the attaching apparatus 10 because of pivotal movement of the upper power arm 55.

The feed in finger 32 is moved outwardly during the first half of each cycle of operation and inwardly during the second half of each cycle of operation. The feed in finger 45 is moved inwardly at the end of each cycle of operation and outwardly at the start of each cycle of operation.

The upper power arm 55 also is connected to a ram 122 for causing axial motion of the ram 122, which is slidably disposed within a housing 122A supported by the plate-like support 20 and having a cover 122B attached thereto, in both directions. This connection includes a pivot block 123 (see FIG. 2) having pivot pins 124 and 125 extending from opposite sides thereof for disposition in openings 126 and 127 in the two brackets 110 (one shown in FIG. 1B), on the upper power arm 55 to pivotally support the pivot block 123 (see FIG. 2) on the upper power arm 55 (see FIG. 1B).

The pivot block 123 (see FIG. 2) supports a clevis 128 through the clevis 128 having a threaded rod 129 on its upper end extending through a passage (not shown) in the pivot block 123. An overtravel spring 131 surrounds the threaded rod 129 between a cap nut 132 on the end of the threaded rod 129 and the pivot block 123. Thus, the clevis 128 is resiliently connected to the pivot block 123. The clevis 128 is connected to the ram 122 through the ram 122 having its reduced upper end 133 connected by a shaft 134 to the clevis 128.

The ram 122 has an elongated recess 135 extending inwardly from its bottom end to receive the plunger 104. The plunger 104 is connected to the ram 122 by two set screws 135A engaging two flats (not shown) on the plunger 104.

The plunger 104 has a spring 136 disposed therein with one end of the spring 136 engaging a screw 137 at the upper end of the plunger 104. The other end of the spring 136 engages a head 138 of a pin 139, which engages the bolt 106. Therefore, downward movement of the ram 122 by the upper power arm 55 (see FIG. 1B) causes the die 105 (see FIG. 2) to be moved downwardly.

The rivet 12 (see FIG. 3) is held in position by a pair of pivotally mounted jaws 140 (see FIG. 2) and 141 gripping the elongated portion 16 (see FIG. 3) of the rivet 12. When a holder 142 (see FIG. 2) is moved upwardly, the elongated portion 16 (see FIG. 3) of the rivet 12 is moved upwardly out of gripping engagement by the jaws 140 (see FIG. 2) and 141. The holder 142 is moved upwardly by pivotal movement of the lower power arm 50 during each cycle of operation of the attaching apparatus 10.

Each of the jaws 140 and 141 is pivotally mounted on an anvil block 143 by a screw 144. Springs 145 and 146, which are mounted on the anvil block 143, continuously urge the jaws 140 and 141, respectively, towards each other.

The anvil block 143 is supported on the plate-like support 20. A rail 147 (see FIG. 1B), which has the guide channel 27 along which the rivet 12 (see FIG. 3) is moved by the feed in finger 32 (see FIG. 1B), is supported by the anvil block 143 through a cover 148. The rail 147 has a rail 149, which is supported by the anvil block 143 through a cover 149' (see FIG. 2), for cooperation therewith to define a passage therebetween through which the rivet 12 (see FIG. 3) is advanced along the guide channel 27 (see FIG. 1B) by the feed in finger 32.

A spring 150 (see FIG. 2) surrounds the holder 142 and continuously urges the holder 142 towards an extending screw 151 on the lower power arm 50 at its remote end from the lower end bearing 59 (see FIG. 1A). The screw 151 (see FIG. 1B) lifts the holder 142 during pivotal motion of the lower power arm 50 in each cycle of operation of the attaching apparatus 10. As previously mentioned, pivotal motion of the lower power arm 50 is due to the harmonic motion of the push rod assembly 60 (see FIG. 1A), which functions as a crank arm, created by rotation of the cam 62.

When the ram 122 (see FIG. 2) and the attached plunger 104 are moved downwardly, the side plates 103 and 102 engage the material 14 to hold the material 14 against upper surfaces 152 and 153, respectively, of the covers 148 and 149', respectively. As the holder 142 is moved upwardly against the force of the spring 150 when the lower power arm 50 pivots to move the screw 151 into engagement with the holder 142, a top surface 154 of the holder 142 receives the head 17 (see FIG. 3) of the rivet 12 and the jaws 140 (see FIG. 2) and 141 are cammed out of engagement with the elongated portion 16 (see FIG. 3) of the rivet 12 by the upward movement of the holder 142 (see FIG. 2). The holder 142 has the top surface 154 formed to receive and hold the head 17 (see FIG. 3) of the rivet 12 with the elongated portion 16 extending upwardly and gripped by the pair of pivotally mounted jaws 140 (see FIG. 2) and 141.

Figure 3:
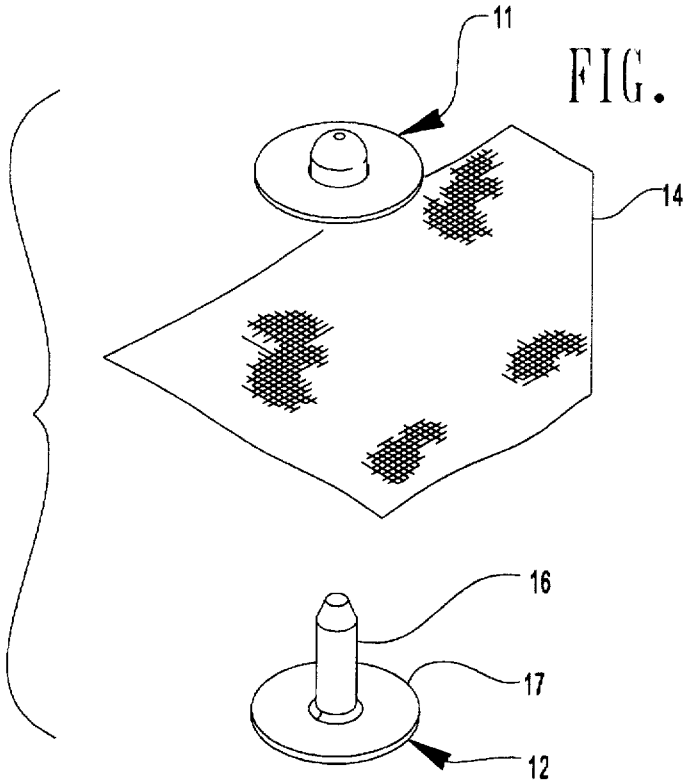
FIG. 3 is a perspective view of a rivet, a burr to which the rivet is to be attached, and material through which the rivet passes when the rivet and the burr are attached to each other by the attaching apparatus of FIG. 1.

As the holder 142 is moved upwardly, the elongated portion 16 (see FIG. 3) of the rivet 12 enters the cavity or recess 15 (see FIG. 4) in the burr 11 after passing through the material 14 (see FIG. 3). Each of the side plates 102 (see FIG. 2) and 103 has a surface 155 and 156, respectively, to receive an arcuate part of the bottom circular periphery of the burr 11 (see FIG. 3).

As the ram 122 (see FIG. 2) and the plunger 104 are moved downwardly, the guide plates 103 and 102 are prevented from further movement because of engagement with the upper surfaces 152 and 153, respectively, of the covers 148 and 149', respectively. However, the ram 122 and the plunger 104 can continue to move because the side plates 102 and 103 are resiliently connected to the plunger 104. The resilient connection includes the spring 136.

As the plunger 104 moves downwardly relative to the side plates 102 and 103, the die 105 engages the burr 11 (see FIG. 3) to move the bottom of the burr 11 towards the material 14 (see FIG. 2) and the upper surfaces 152 and 153 of the covers 148 and 149', respectively. Thus, the die 105 is supporting the burr 11 (see FIG. 3) when the holder 142 (see FIG. 2) moves upwardly to move the elongated portion 16 (see FIG. 3) of the rivet 12 into the cavity or recess 15 (see FIG. 4) in the burr 11. This causes deformation of the elongated portion 16 (see FIG. 3) of the rivet 12 within the cavity or recess 15 (see FIG. 4) in the burr 11. It should be understood that downward movement of the die 105 (see FIG. 2) and the burr 11 (see FIG. 3) ceases before deformation of the elongated portion 16 (see FIG. 3) of the rivet 12 begins.

The springs 108 (see FIG. 2) and 109 enable the side plates 102 and 103 to separate slightly from each other to cease to hold the burr 11 (see FIG. 3).

Figure 7:
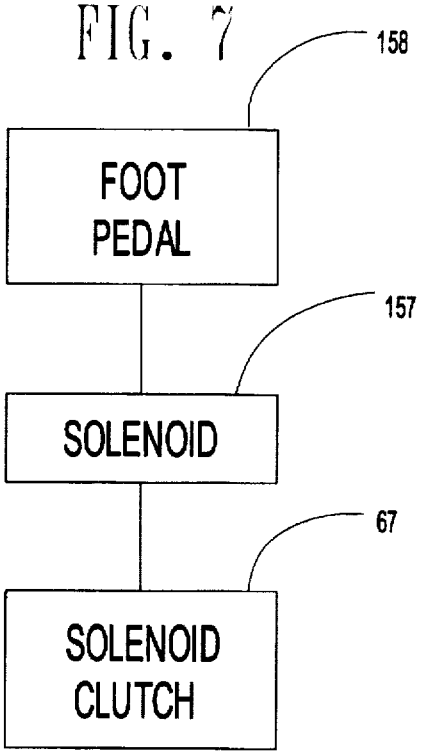
FIG. 7 is a schematic block diagram of a portion of an electrical control system for the attaching apparatus.

It should be understood that the clutch 67 (see FIG. 6) is energized by a solenoid clutch switch 157 (see FIG. 7) being activated. The solenoid clutch switch 157 is preferably activated by a foot pedal 158 being depressed by an operator of the attaching apparatus 10 (see FIGS. 1A and 1B) to begin a cycle of operation of the attaching apparatus 10.

Considering the operation of the attaching apparatus 10 (see FIG. 1B), the feed chute 24 is substantially filled from the first hopper with the rivets 12 (see FIG. 3). The upper feed chute 33 (see FIG. 2) and the curved lower feed chute 38 are substantially filled with the burrs 11 (see FIG. 3) from the second hopper.

The cycle of operation of the attaching apparatus 10 (see FIGS. 1A and 1B) begins with the solenoid clutch switch 157 (see FIG. 7) being closed. This closing of the solenoid clutch switch 157 energizes the one revolution solenoid clutch 67 (see FIG. 6) to connect the flywheel 68 to the cam shaft 65 to rotate the cam shaft 65 and the attached cam 62 (see FIG. 1A) through one revolution. The solenoid clutch 67 (see FIG. 6) is automatically inactivated at the end of each revolution of the cam shaft 65.

Rotation of the cam 62 (see FIG. 1A) causes the upper power arm 55 to begin to pivot through a rising first portion of the profile or contour of the cam 62 engaging the cam follower 88 on the upper power arm 55 to cause the upper power arm 55 to pivot clockwise. During the initial pivoting of the upper power arm 55, the feed in finger 45 (see FIG. 1B) is moved away from the setting station 46.

It should be understood that the ram 122 is held at a fixed position at the end of each cycle of operation through the cap nut 132 on the upper end of the threaded rod 129 engaging a fixed stop 300 adjustably supported on a bracket 301, which is fixed to the plate-like support 20. After the feed in finger 45 is moved away from the setting station 46 at the start of a cycle of operation of the attaching apparatus 10, the ram 122 is moved downwardly by the pivotal movement of the upper power arm 55.

During the first 180° of rotation of the cam shaft 65 (see FIG. 6), the feed in finger 32 (see FIG. 1B) is withdrawn from the setting station 46. This withdrawal of the feed in finger 32 enables another of the rivets 12 (see FIG. 3) to enter the guide channel 27 (see FIG. 1B) from the curved lower rail mount 28. During the second 180 ° of rotation of the cam shaft 65 (see FIG. 6), the feed in finger 32 (see FIG. 1B) feeds one of the rivets 12 (see FIG. 3) to the setting station 46 (see FIG. 1B).

When the ram 122 moves down, the die 105 (see FIG. 2), which is carried by the plunger 104 attached to the ram 122, engages the burr 11 (see FIG. 3). This exerts a force on the burr 11 to move the burr 11 towards the rivet 12.

After the ram 122 (see FIG. 1B) has almost completed its downward motion, the holder 142 is lifted upwardly due to pivoting of the lower power arm 50, which is under control of the cam 62 (see FIG. 1A) through the push rod assembly 60 connecting the lower power arm 50 to the cam 62. Engagement of the screw 151 on the lower power arm 50 with the bottom of the holder 142 does not begin until pivoting of the lower power arm 50 has begun. Thus, the holder 142 does not begin upward movement until after the ram 122 starts down. The position of the screw 151 in the lower power arm 50 is adjustable to control when movement of the holder 142 by the lower power arm 50 starts during each cycle of operation.

After downward motion of the ram 122 (see FIG. 1B) is stopped by a constant second portion of the profile or contour of the cam 62 (see FIG. 1A) ceasing to move the upper power arm 55, the upper power arm 55 is held in its stopped position by the constant second portion of the profile or contour of the cam 62 so that the ram 122 (see FIG. 1B) is held in its stopped position as the cam 62 (see FIG. 1A) continues to rotate. Further upward movement of the holder 142 (see FIG. 1B) moves the elongated portion 16 (see FIG. 3) of the rivet 12 into the cavity or recess 15 (see FIG. 4) in the burr 11 after the elongated portion 16 (see FIG. 3) of the rivet 12 passes through the material 14.

Continued rotation of the cam shaft 65 (see FIG. 6) results in the lower power arm 50 (see FIG. 1A) being pivoted by the connection of the cam 62 to the lower power arm 50 through the push rod assembly 60 to allow the spring 150 (see FIG. 2) to return the holder 142 to a position in which the jaws 140 and 141 are no longer held apart. This disposes the jaws 140 and 141 to receive another of the rivets 12 (see FIG. 3) during the next cycle of operation of the attaching apparatus 10 (see FIG. 1B).

Continued rotation of the cam 62 (see FIG. 1A) causes a falling third portion of its cam profile or contour to engage the cam follower 88. As the cam follower 88 on the upper power arm 55 follows the falling third portion of the cam profile or contour of the cam 62, this results in the spring 87 pivoting the upper power arm 55 counterclockwise. The counterclockwise pivotal movement of the upper power arm 55 causes upward motion of the ram 122 and movement of the feed in finger 45 to advance another of the burrs 11 (see FIG. 3) through the guide channel 43 (see FIG. 5) to the setting station 46 (see FIG. 1B).

The feed in finger 32 also advances another of the rivets 12 (see FIG. 3) through the guide channel 27 (see FIG. 1B) to the setting station 46 during upward motion of the ram 122. The cycle ends with the ram 122 being held in a fixed position through the cap nut 132 on the upper end of the threaded rod 129 engaging the fixed stop 300 on the plate-like support 20.

The magnitude of the setting force on the rivet 12 (see FIG. 3) is determined by the force of the compression spring 60J (see FIG. 1A). If the compressive force of the spring 60J is increased, the force exerted by the lower power arm 50 on the holder 142 (see FIG. 1B) is increased to increase the setting force and vice versa. The compressive force of the spring 60J (see FIG. 1A) is adjusted by changing the position of the jam nut 60K on the threaded upper portion of the shaft 60E.

If the rivets 12 (see FIG. 3) are replaced with another type of fastener element, it may be necessary to replace the feed chute 24 (see FIG. 1B) and the curved lower rail mount 28 to conform to the configuration of the new type of fastener element. If the burrs 11 (see FIG. 3) are replaced with another type of fastener element, it may be necessary to replace the upper feed chute 33 (see FIG. 2) and the curved lower feed chute 38 to conform to the configuration of the new type of fastener element.

It should be understood that the die 105 must cease to move downward before deformation of the rivet 12 (see FIG. 3) begins. Thus, this ceasing of movement can be as late as when the elongated portion 16 of the rivet 12 enters the cavity 15 (see FIG. 4) of the burr 11 or as early as when the rivet 12 (see FIG. 3) begins its upward motion.

An advantage of this invention is that it attaches fastener elements requiring a plurality of different setting forces. Another advantage of this invention is that timing of the motion of the ram is controlled so that it is stopped prior to the lower fastener element engaging the upper fastener element. A further advantage of this invention is that it avoids any movement of the material during attachment of the fastener elements thereto.

For purposes of exemplification, a particular embodiment of the invention has been shown and described according to the best present understanding thereof. However, it will be apparent that changes and modifications in the arrangement and construction of the parts thereof may be resorted to without departing from the spirit and scope of the invention.

I claim:

1. An attaching apparatus for attaching first and second mating fastener elements to material at a setting station including:

support means and ram means at the setting station;

first disposing means for disposing a first fastener element at the setting station in a specific orientation for engagement by one of said support means and said ram means;

second disposing means for disposing a second fastener element at the setting station in a specific orientation for engagement by the other of said support means and said ram means;

moving means for creating movement of said support means and said ram means towards each other to attach the first fastener element and the second fastener element to each other at the setting station;

and said moving means including:

a single power source for creating movement of said support means and said ram means towards each other;

a first pivotally mounted arm for causing movement of said ram means when said single power source creates movement of said first pivotally mounted arm;

a second pivotally mounted arm for causing movement of said support means when said single power source creates movement of said second pivotally mounted arm;

and activation control means for controlling activation of each of said first pivotally mounted arm and said second pivotally mounted arm during a cycle of operation of said attaching apparatus, said activation control means causing movement of said ram means to be stopped prior to causing movement of said support means to be stopped during attachment of the first fastener element and the second fastener element to each other at the setting station.

2. The attaching apparatus according to claim 1 including:

said single power source including:

an electric motor;

and a flywheel continuously driven by said electric motor when said electric motor is energized;

and selective connecting means for selectively connecting said flywheel to said activation control means to produce a cycle of operation of said attaching apparatus.

3. The attaching apparatus according to claim 2 in which said activation control means includes:

a cam connected to said flywheel by said selective connecting means for rotation through one revolution during each cycle of operation, said cam cooperating with said first pivotally mounted arm to move said first pivotally mounted arm during each cycle of operation and to stop movement of said first pivotally mounted arm to stop said ram means prior to movement of said support means being stopped;

and causing means for causing movement of said second pivotally mounted arm by said single power source during each cycle of operation.

4. The attaching apparatus according to claim 3 in which said causing means of said activation control means includes connecting means for connecting said second pivotally mounted arm to said cam of said activation control means.

5. The attaching apparatus according to claim 4 including fixed stop means for engaging said first pivotally mounted arm at the end of each cycle of operation to dispose said first pivotally mounted arm at a predetermined position at the start of each cycle of operation.

6. The attaching apparatus according to claim 5 including connecting means for connecting said first pivotally mounted arm to said ram means to cause movement of said ram means in response to movement of said first pivotally mounted arm.

7. The attaching apparatus according to claim 1 in which said activation control means includes a cam connected to said single power source for rotation through one revolution during each cycle of operation, said cam cooperating with said first pivotally mounted arm to move said first pivotally mounted arm during each cycle of operation and to stop movement of said first pivotally mounted arm to stop said ram means prior to movement of said support means being stopped.

8. The attaching apparatus according to claim 7 in which said activation control means includes causing means for causing movement of said second pivotally mounted arm by said single power source during each cycle of operation.

9. The attaching apparatus according to claim 8 in which said causing means of said activation control means includes connecting means for connecting said second pivotally mounted arm to said cam of said activation control means.

10. The attaching apparatus according to claim 7 including:

said first pivotally mounted arm being connected to said ram means and having a cam follower thereon;

said cam having a cam profile for cooperating with said cam follower;

and said cam profile including a first portion for causing said first pivotally mounted arm to pivot to move said ram means to a stopped position and a second portion for holding said first pivotally mounted arm at a stopped position to hold said ram means at its stopped position against movement.

11. The attaching apparatus according to claim 1 including means for controlling the setting force applied to said support means by said second pivotally mounted arm.

12. The attaching apparatus according to claim 1 including means for controlling when movement of said support means by said second pivotally mounted arm starts during each cycle of operation.

13. An attaching apparatus for attaching first and second mating fastener elements to material at a setting station including:

support means and ram means at the setting station;

first disposing means for disposing a first fastener element at the setting station in a specific orientation for engagement by one of said support means and said ram means;

second disposing means for disposing a second fastener element at the setting station in a specific orientation for engagement by the other of said support means and said ram means;

moving means for creating movement of said support means and said ram means towards each other to attach the first fastener element and the second fastener element to each other at the setting station;

and said moving means including:

a single power source for creating movement of said support means and said ram means towards each other;

first causing means for causing movement of said ram means when said single power source creates movement of said first causing means;

second causing means for causing movement of said support means when said single power source creates movement of said second causing means;

and activation control means for controlling activation of each of said first causing means and said second causing means during a cycle of operation of said attaching apparatus, said activation control means causing movement of said ram means to be stopped prior to causing movement of said support means to be stopped during attachment of the first fastener element and the second fastener element to each other at the setting station.

14. The attaching apparatus according to claim 13 including:

said first causing means including a first movable arm connected to said ram means;

said activation control means including a cam driven by said single power source through one revolution during each cycle of operation;

and said cam cooperating with said first movable arm to move said first movable arm during each cycle of operation and to stop movement of said first movable arm to stop said ram means prior to movement of said support means being stopped during attachment of the first fastener element and the second fastener element to each other at the setting station.

15. The attaching apparatus according to claim 14 in which said cam includes means for holding said first movable arm at a stopped position to hold said ram means at its stopped position against movement.

16. The attaching apparatus according to claim 13 including said first causing means of said moving means including means for stopping said ram means at a stopped position after movement of said ram means has caused engagement of said ram means with the first fastener element and prior to attachment of the first fastener element and the second fastener element to each other during movement of said support means by said second causing means of said moving means, said first causing means of said moving means including means for holding said ram means at its stopped position until the first and second fastener elements are attached to each other and the material.

17. The attaching apparatus according to claim 13 including:

said first causing means including a first movable arm connected to said ram means and having a cam follower thereon;

said activation control means including a cam driven by said single power source through one revolution during each cycle of operation;

said cam having a cam profile for cooperating with said cam follower;

and said cam profile including a first portion for causing said first movable arm to move said ram means to a stopped position and a second portion for holding said first movable arm at a stopped position to hold said ram means at its stopped position against movement.

18. The attaching apparatus according to claim 13 in which said activation control means includes means for holding said ram means at its stopped position.

19. The attaching apparatus according to claim 13 including means for controlling the setting force applied to said support means by said second pivotally mounted arm.

20. The attaching apparatus according to claim 13 including means for controlling when movement of said support means by said second causing means starts during each cycle of operation.

* * * * *

UNITED STATES PATENT AND TRADEMARK OFFICE

CERTIFICATE OF CORRECTION

PATENT NO. : 5,781.989

DATED : July 21, 1998

INVENTOR(S) : Volker Schmidt

It is certified that error appears in the above-identified patent and that said Letters Patent is hereby corrected as shown below:

Column 5, line 5, cancel "into a" (second occurrence)

Signed and Sealed this

Twentieth Day of October, 1998

Bruce Lehman

*Attest:*

BRUCE LEHMAN

*Attesting Officer*

*Commissioner of Patents and Trademarks*